US008062093B2

(12) United States Patent
DeSousa

(10) Patent No.: US 8,062,093 B2
(45) Date of Patent: Nov. 22, 2011

(54) CLEAVAGE ACCESSORY FOR A BRASSIERE

(76) Inventor: Michelle Elizabeth DeSousa, Naples, FL (US)

( * ) Notice: Subject to any disclaimer, the term of this patent is extended or adjusted under 35 U.S.C. 154(b) by 68 days.

(21) Appl. No.: 12/586,622

(22) Filed: Sep. 25, 2009

(65) Prior Publication Data

US 2010/0022162 A1 Jan. 28, 2010

Related U.S. Application Data

(63) Continuation-in-part of application No. 11/855,131, filed on Sep. 13, 2007, now abandoned.

(51) Int. Cl.
*A41C 3/00* (2006.01)

(52) U.S. Cl. ..... 450/30; 450/33; 450/1; 2/46; 2/105; 2/106

(58) Field of Classification Search ..... 450/1, 30–35, 450/63, 70–74, 77–80, 82, 86, 88, 87, 92, 450/93; 2/912, 913, 69, 73–75, 90, 96, 102–106, 2/109, 110, 113–114, 118, 67, 119, 122, 2/129, 133, 46, 50–54
See application file for complete search history.

(56) References Cited

U.S. PATENT DOCUMENTS

| | | | | | |
|---|---|---|---|---|---|
| 626,589 | A * | 6/1899 | Buchner | 450/28 |
| 731,759 | A * | 6/1903 | Dieter | 2/48 |
| 770,752 | A * | 9/1904 | Hull | 2/54 |
| 1,645,995 | A * | 10/1927 | McCarthy | 2/92 |
| 2,472,606 | A * | 6/1949 | Michaelson | 450/86 |
| 2,707,786 | A * | 5/1955 | Stoner | 2/119 |
| 3,064,265 | A * | 11/1962 | Bridgewaters | 2/74 |
| 4,955,846 | A * | 9/1990 | Greenberg | 450/69 |
| 6,205,585 | B1 * | 3/2001 | Capparelli | 2/106 |
| 6,550,067 | B2 * | 4/2003 | Force | 2/104 |
| 6,935,921 | B1 * | 8/2005 | Eudenbach et al. | 450/54 |
| 2006/0277648 | A1 * | 12/2006 | Harry | 2/69 |
| 2007/0281585 | A1 * | 12/2007 | Calamari et al. | 450/1 |

FOREIGN PATENT DOCUMENTS

| | | | |
|---|---|---|---|
| KR | 20-0297748 | Y1 | 12/2002 |
| KR | 20-0382325 | Y1 | 4/2005 |
| KR | 20-0442771 | Y1 | 12/2008 |
| KR | 10-2009-0012902 | A | 2/2009 |
| WO | 2009/125939 | A2 | 10/2009 |

OTHER PUBLICATIONS

International Search Report and Written Opinion dated Jun. 29, 2011 from corresponding International Application No. PCT/US2010/049948, 7 pages.

* cited by examiner

*Primary Examiner* — Gloria Hale
(74) *Attorney, Agent, or Firm* — Maier & Maier, PLLC

(57) ABSTRACT

The invention is directed to an accessory which is fabricated and shaped to cover the bosom area of body. It is particularly useful when applied to a brassiere showing a cleavage of a human body at a center thereof. The accessory, when applied to a brassiere will cover the cleavage area of a wearer to simulate an undergarment. The inventive accessory can be removed from the brassiere when the person is in a different social setting. The accessory can be fabricated from different materials but it is preferred to be stretchable so that it can be applied to differently sized brassieres and the accessory, additionally, can move with the movements of the wearer. It is preferred that the fabric of the accessory be doubled over so that most of the fastening elements do not touch the skin of the wearer which adds to the comfort of wearing the accessory.

1 Claim, 4 Drawing Sheets

CLEAVAGE ACCESSORY FOR A BRASSIERE

This application is a Continuation-In-Part of U.S. patent application Ser. No. 11/855,131, filed on Sep. 13, 2007, now abandoned.

BACKGROUND OF THE INVENTION

The present invention is directed to an accessory which is fabricated and shaped to cover the exposed bosom area of the body. Work environments as well as other environments, dress code restrictions apply to the revealing of the cleavage of the women's bosom area. In certain situations and environments the extent of opposed cleavage area makes the woman uncomfortable. Numerous garments are designed to show off the cleavage area, thus the garments restricts the user from wearing a certain garment whenever they chose to.

U.S. Pat. No. 4,955,846 illustrates a brassiere whereby an exposed cleavage on a woman's body may be adjusted by a band in the center of the brassiere which is instrumental in ruffling the fabric of the center to show more or less of a cleavage.

Published application No. 2007/0281585 illustrates a triangular piece of fabric representing a partial undergarment that is designed to cover an exposed cleavage of a woman's body.

BRIEF DESCRIPTION OF THE INVENTION

The inventive concept involves the attachment of materials at the center of the bosom area of a brassiere which materials may be of many types to simulate an undergarment and with the intent to conceal the cleavage area of the bosom. The piece of fabric is designed to be removable and the user may choose to attach or detach the piece of fabric from the bosom area of a brassiere. This feature will allow the user to instantly remove the piece of fabric from the garment after exiting prohibited or restricted environments. As an example, the user may have it attached during working hours and after work may instantly remove the fabric which may be called an accessory.

In one embodiment, the accessory attaches to the brassiere as a permanent non-removable item.

In another embodiment, the accessory selectively attaches to the brassiere as a removable and replaceable item.

The fastening elements are variable and may be snaps, VELCRO® or hook and loop fasteners, and are located at suitable locations on the accessory. The fabric of the accessory is stretchable whereby it may be used on differently sized brassieres and the accessory may move with the various movements of the wearer without inhibiting the same.

DETAILED DESCRIPTION OF THE INVENTION

Figure 1:
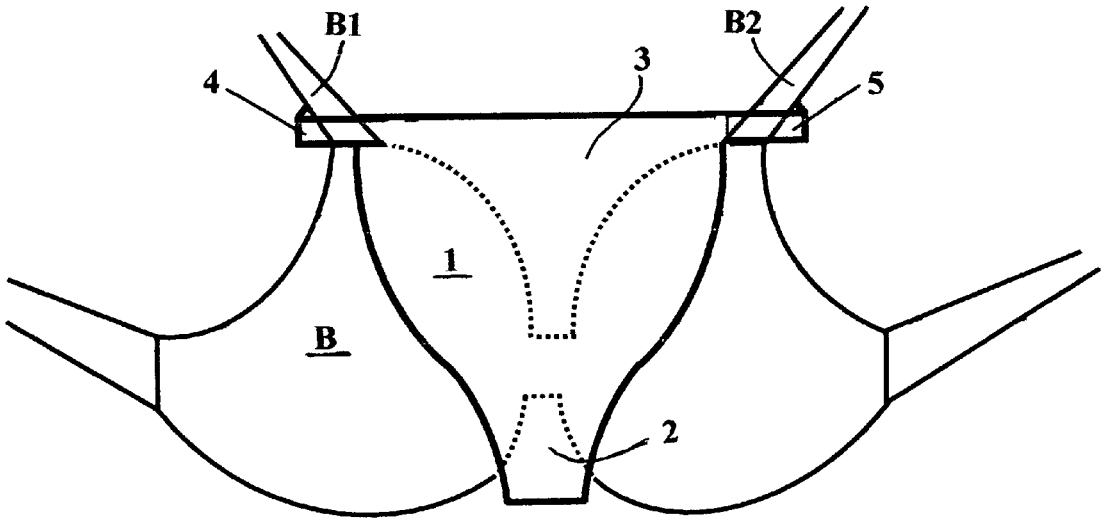
FIG. 1 shows an insert inserted in a ready-made brassiere.

FIG. 1 illustrates an accessory 1 that is attached to an outside surface of a brassiere B. The accessory 1 has a bottom end 2 of the triangular accessory that is turned under the bottom end of the brassiere and a top end 3 that is visible from the outside of the brassiere and forms an appearance of an undergarment. There is an inside stretchable band in the top end of the brassiere and the ends are shown at 4 and 5. The ends will be fastened to the left B1 and right B2 shoulder straps of the brassiere which will be shown in detail at subsequent Figs.

Figure 2:
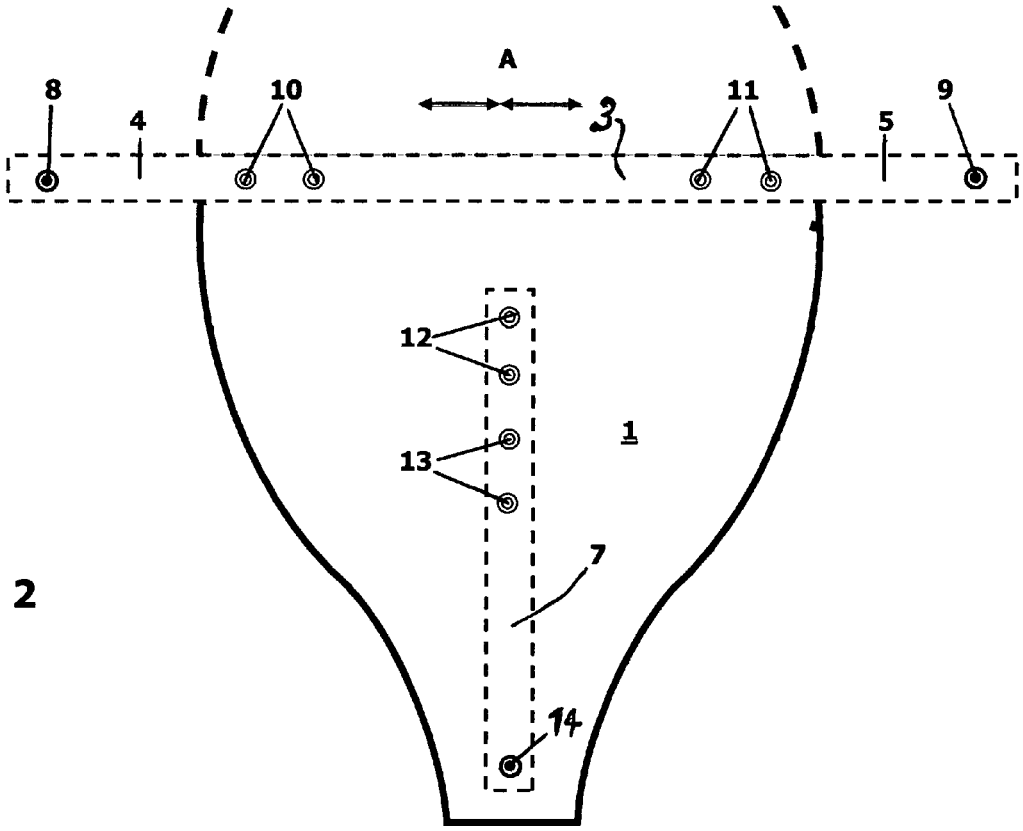
FIG. 2 is a plan view of the inventive accessory.

FIG. 2 is a plan view of the triangularly shaped accessory 1. The fabric of the accessory 1 is somewhat stretchable so that the accessory my be applied to differently sized brassieres or the fabric may move with the various movements of the wearer. The top of the accessory has a stretchable band 3 placed therein. The stretch ability of this band is indicated by the arrow A. The ends of the band 3 are shown as 4 and 5 which ends will extend to some extent beyond the top of the accessory which ends 4 and 5 will be fastened to the shoulder straps of the brassiere as shown in FIG. 1. At each end 4 and 5 of the band there are located fasteners 8 and 9, respectively, which use will be shown subsequent Figs. As the band 3 with its ends 4 and 5 will be turned on themselves around the shoulder straps to meet with respective fastening elements 10 and 11. In the center of the accessory 1 there is located or placed a vertical band 7 which is also stretchable so that it can stretch when the fabric of the accessory 1 is stretching. The basic fabric of the accessory is doubled over on itself so that the top band 3 and the vertical band are hidden within the fabric and only the respective fasteners are visible but will somewhat be hidden so as not to interfere with the bare skin of the wearer. The center vertical band 7 fasteners 12 and 13 placed thereon and a single fastener 14 is placed at the bottom of the triangularly shaped accessory. The bottom fastener will be fastened to any of the upper fasteners 12 and 13 depending on the size of the brassiere. The bottom end of the triangular accessory will be turned up and under the bottom of the brassiere so that the fastener 14 movable therewith can be attached to any of the fasteners 12 and 13.

Figure 3:
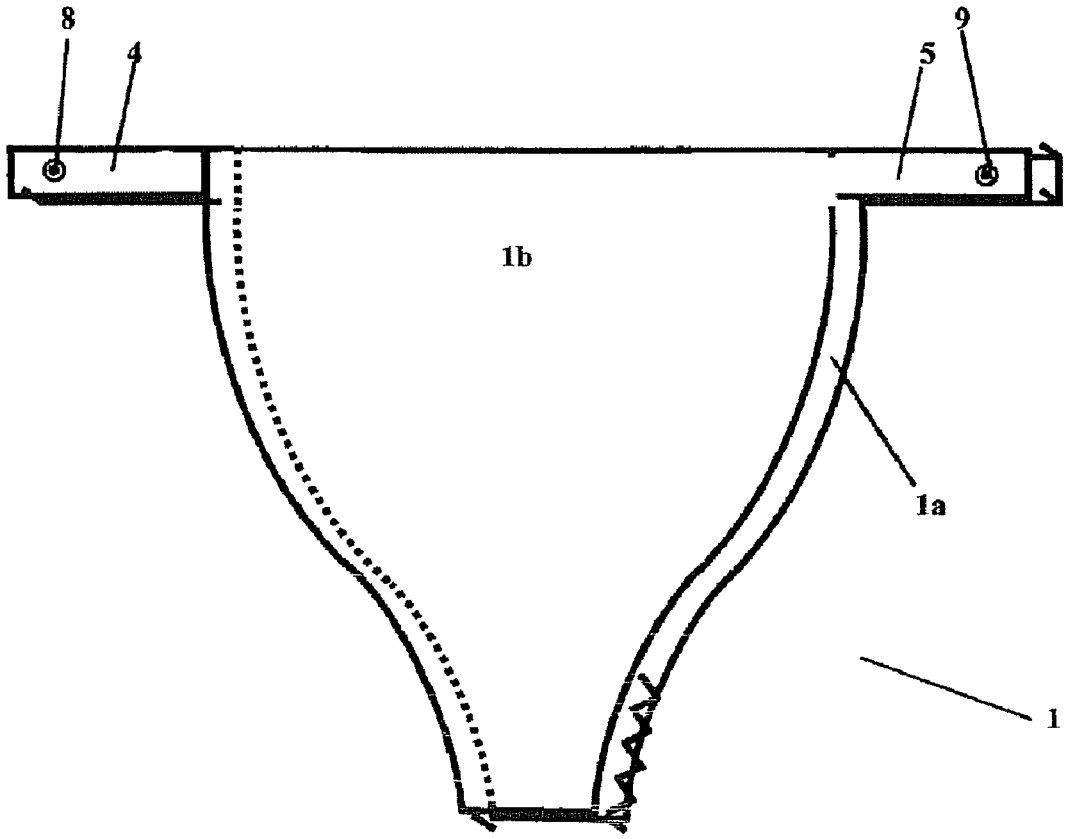
FIG. 3 is an outside view of the accessory.

FIG. 3 is an outside view of the accessory 1. As mentioned above, the stretchable fabric of the accessory is doubled over the top band as can be seen by the outside fabric 1*b* and the inside fabric 1*a*. The ends 4 and 5 of the top band can be seen on the right and left side of the accessory including the respective fasteners 8 and 9.

Figure 4:
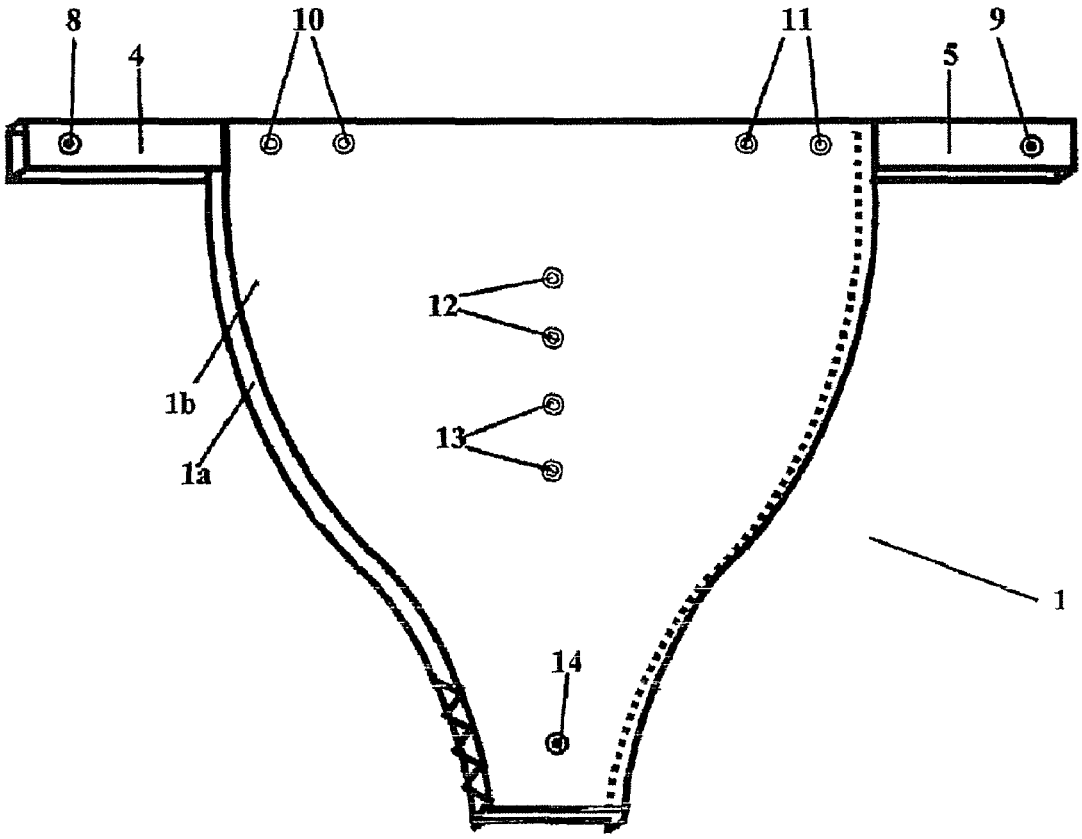
FIG. 4 is an inside view of the accessory.

FIG. 4 is in inside view of the accessory 1. Again the doubled over fabric can be seen at 1*b* and 1*a*. The respective ends of the top band can be seen at 4 and 5 including the respective fasteners 8 and 9. The fasteners 8 and 9 will be attached to their respective fasteners 10 and 11 depending on the size of the brassiere. The same is true with the bottom fastener 14 which will be matched with either of the fasteners 12 and 13 depending on the required overlap of the bottom of the accessory.

Operation

When the occasion presents itself to cover the exposed cleavage of a woman's body by way of a brassiere and, of course a garment, the triangular fabric is placed over the center of the brassiere. The upper exposed ends 4 and 5 are placed around the brassiere shoulder straps B1 and B2 and the movable fasteners 8 and 9, moving with the exposed ends 4 and 5 are now fastened to their respective fasteners 10 and 11. Because the elastic fabric is doubled, both of the movable fasteners 8 and 9 are hidden in the fabric and they cannot touch the skin of the wearer. Thereafter, the lower end of the triangle is doubled over and moved under the fabric of the accessory and the doubled end is placed under the bottom end of the brassiere and moved upwardly to meet any of the stationary fasteners 12 and 13 and the movable bottom fastener 14 is matched with any of the respective fasteners 12 or 13 and attached thereto. Due to the fact that the fabric of the accessory is doubled, the movable fastener 14 is hidden in the fabric and therefore cannot touch the skin of the wearer which adds to the comfort of wearing the accessory. Another important feature of the inventive concept is the fact that no fasteners can be seen from the outside of the accessory. This adds considerably to the appearance of the garment.

I claim:

1. A removable brassiere accessory worn at a center of a brassiere to cover a cleavage created by the brassiere, comprising:

a stretchable substantially triangular brassiere accessory formed from an inner triangle layer of fabric and an outer triangle layer of fabric;

a top portion of the brassiere accessory having a stretchable horizontal band disposed between the inner triangle layer of fabric and the outer triangle layer of fabric with two ends located thereon, the two ends extending outwardly from the top portion of the brassiere accessory, the two ends of the stretchable horizontal band having selectively attachable fastening elements extending outwardly from the inner triangle layer of fabric and inner portions of the stretchable horizontal band having multiple fixed complementary fastening elements extending outwardly from the inner triangle layer of fabric that matingly attach to the selectively attachable fastening elements extending outwardly from the two ends of the stretchable horizontal band; and a center portion of the brassiere accessory having a stretchable vertical band located thereon, with a bottom portion of the stretchable vertical band having a selectively attachable fastening element extending outwardly from the inner triangle layer of fabric and a top portion of the stretchable vertical band having multiple fixed fastening elements extending outwardly from the inner piece of fabric that matingly attach to the selectively attachable fastening elements extending outwardly from the bottom portion of the stretchable vertical band;

wherein the attachment of the fastening elements on the two ends of the stretchable horizontal band to the complementary fastening elements on the inner portions of the stretchable horizontal band occurs around shoulder straps of a brassiere and the attachment of the selectively attachable fastening element on the bottom portion of the stretchable vertical band to the complementary fastening elements on the top portion of the stretchable vertical band occurs over the center of the brassiere.

* * * * *